United States Patent [19]

Lodewegen

[11] Patent Number: 5,069,019

[45] Date of Patent: Dec. 3, 1991

[54] APPARATUS AND METHOD OF CONVEYING AND BOXING FROZEN PATTIES

[76] Inventor: Lloyd E. Lodewegen, 12455 198th St., Hastings, Minn. 55033

[21] Appl. No.: 583,840

[22] Filed: Sep. 17, 1990

[51] Int. Cl.[5] ..... B65B 25/06; B65B 35/24; B65B 35/32; B65B 35/44

[52] U.S. Cl. ..... 53/443; 53/447; 53/500; 53/504; 53/532; 53/535; 53/540; 53/247; 53/254; 53/260; 209/601; 209/698; 414/790.5; 414/793.4; 414/926

[58] Field of Search ..... 53/532, 540, 254, 260, 53/259, 244, 54, 500, 535, 536, 443, 475, 447, 247, 504; 414/901, 924, 926, 790.5, 793.4, 794.3; 209/551, 548, 601, 600, 698

[56] References Cited

U.S. PATENT DOCUMENTS

| | | | |
|---|---|---|---|
| 2,849,236 | 8/1958 | Beaulieu | 414/790.4 X |
| 3,105,333 | 10/1963 | Desnick | 53/260 X |
| 3,488,917 | 1/1970 | Oswald et al. | 53/535 X |
| 3,641,735 | 2/1972 | Daily et al. | 53/540 X |
| 4,192,121 | 3/1980 | Caudle | 53/260 X |
| 4,236,855 | 12/1980 | Wagner et al. | 53/540 X |
| 4,260,309 | 4/1981 | Lynn | 414/924 X |
| 4,679,381 | 7/1987 | Truninger | 53/540 X |
| 4,736,570 | 4/1988 | Hardage et al. | 53/500 X |
| 4,756,399 | 7/1988 | Scata | 209/698 X |

*Primary Examiner*—Horace M. Culver

*Attorney, Agent, or Firm*—Merchant, Gould, Smith, Edell, Welter & Schmidt

[57] ABSTRACT

An apparatus and method for conveying, classifying, and packing goods is disclosed. The goods move on a plurality of lanes to containers for packing. The goods move on conveyors to classifiers where goods outside a predetermined specification are discarded. Goods which meet the specifications move to a counter and retainer. A predetermined number of goods moves to a stacker in a cycle. The stacker moves within a set of spindles configured to receive the goods there between. A controller counts the number of goods stacked in the set of spindles. When a full count is reached the spindles rotate and the goods are placed into a box which is positioned proximate the spindles.

16 Claims, 14 Drawing Sheets

APPARATUS AND METHOD OF CONVEYING AND BOXING FROZEN PATTIES

FIELD OF THE INVENTION

This invention relates generally to a system for conveying, sorting and packing goods, and more particularly, to a unique conveyor and spindle assembly for such a system.

BACKGROUND OF THE INVENTION

Many industries require the boxing or packing of goods for transport to wholesalers and retailers. For example, the meat industry requires that frozen meat patties, such as hamburger and pork, be efficiently packaged for transport. Traditionally, these patties have been hand packed in corrugated boxes. This method requires a large labor force.

Alternatively, there are systems which are currently utilized that move the patties by means of vacuum cups. The patties congregate in areas through use of conveyors. The vacuum cup is moved into place and takes up a number of patties which are moved to boxes. This system does not adequately accommodate an industry where efficiency and cost control are crucial. This vacuum apparatus also requires a large space in the plant. Systems have also been utilized where the patties or goods travel in wire spiral devices. The goods travel on slide plates to an augured trough and by movement of the spiral, the goods fall into an area and are hand packed. RMF of Kansas City, Missouri manufactures this device.

Another example of current packing methods is a system where stacks ten patties high are moved on a conveyor belt and are then packed in boxes by workers. A number of conveyor belts are utilized where the patties fall into an area to form a stack. Another conveyor then moves the stacks to be put in boxes. Formax Inc. of Mokena, Illinois manufactures a device of this type. Like the systems mentioned above, this system does not provide the versatility or efficiency that the present invention provides. This system is very labor intensive.

The present invention addresses the problems associated with the prior art devices and provides for a conveying and boxing system that is automated and particularly suited for a meat processing plant where generally circular frozen patties are boxed for transport.

SUMMARY OF THE INVENTION

The present invention provides a conveying, sorting and packing system which allows automatic and accurate boxing of meat patties within a meat processing plant or the like. The invention allows for goods to be checked for uniform and consistent size, allows for discarding of goods which do not meet desired specifications, spaces goods to fit within boxes, conveys and places the goods in the boxes for transport to the buyer. Conventional systems do not provide the efficiency, safety and cost savings of this invention. This system particularly suits industries which must package disc-shaped articles, such as meat patties.

The control system of the invention allows for accurate boxing of the goods. The correct number of goods is boxed due to the counting mechanisms of the invention. Rather than relying on the worker to keep track of the number of patties he or she is boxing, the present invention automatically controls the number of patties per box.

Because the present invention is automatic, tremendous labor expenses related to other methods of boxing and sorting are eliminated. Rather than employ a number of workers to sort, move and box the goods as is necessary with the prior art systems, the sorting, conveying and packing system of this invention requires workers only monitor the proper functioning of the automatic systems of the present invention. As a result, the amount of manual labor and the work force demands are substantially reduced from conventional methods.

While the present invention will be described with respect to a preferred configuration of the apparatus, and with respect to preferred materials and shapes of construction, it will be understood that other configurations, materials, and shapes could be used for the construction of the apparatus for conveying and packing frozen patties without departing from the spirit and scope of this invention. Various advantages and features of novelty which characterize the invention are pointed out with particularity in the claims annexed hereto and which form a part hereof. However, for a better understanding of the invention and the advantages obtained by its use, reference should be made to the drawings which form a further part hereof and to the accompanying descriptive matter in which there is illustrated and described a preferred embodiment of the invention.

DETAILED DESCRIPTION OF THE PREFERRED EMBODIMENT

Figure 1:
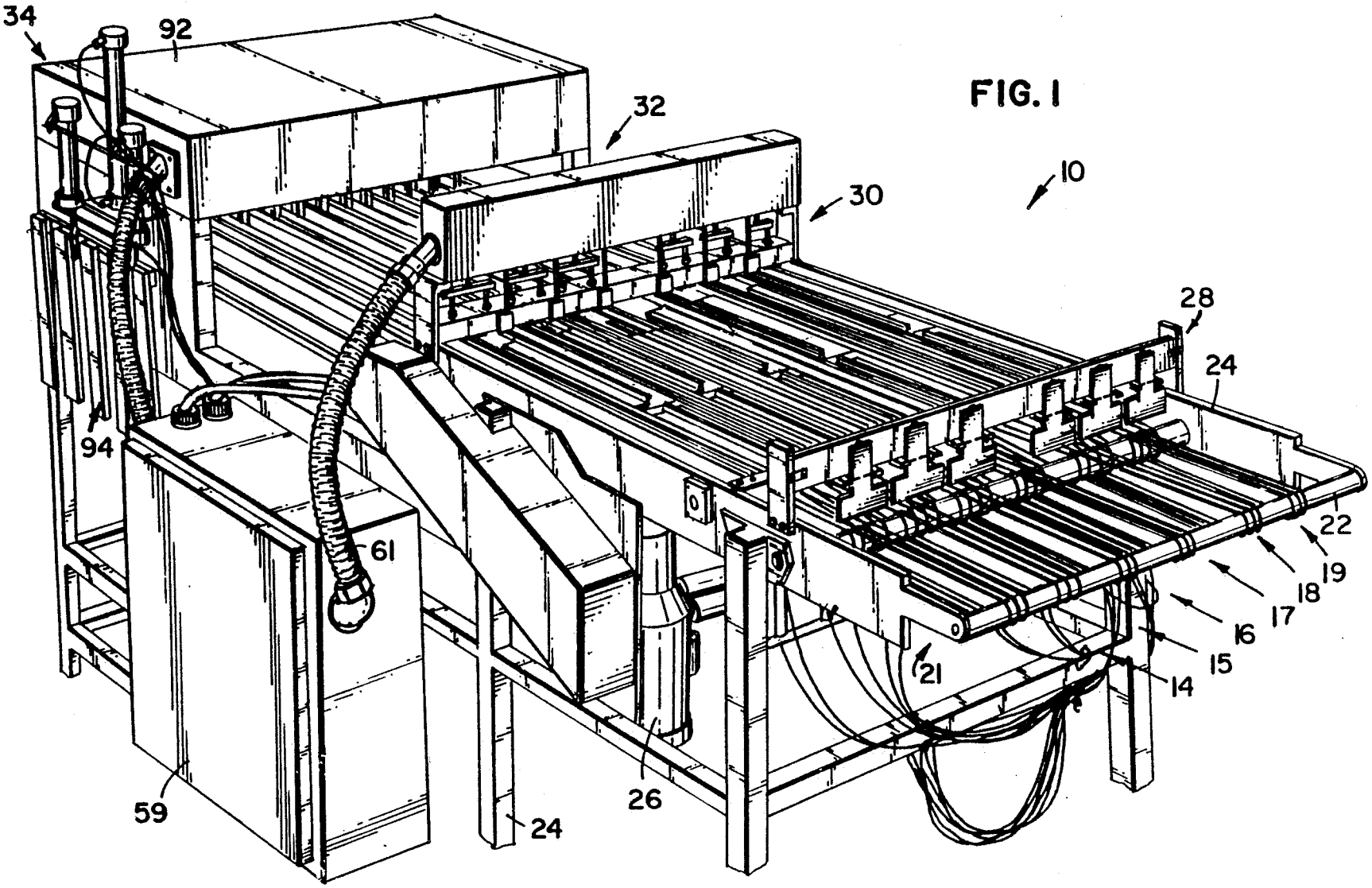
FIG. 1 is a perspective view of the apparatus of the present invention.

Referring to the Drawings, a possible configuration of the apparatus of the present invention is shown at 10 in FIG. 1. Goods 12 (not shown in FIG. 1) are moved onto the apparatus 10 at any of six lanes 14–19 from a production line or the like. The lanes 14–19 move the goods 12 to be boxed. The six lanes 14–19 are identically configured in the preferred embodiment where lanes 14, 15, 16 function as a line to pack the three rows of box A and lanes 17, 18, 19 function as a line to pack the three rows of box B. In the preferred embodiment, the lanes 14–19 move and stack the goods independently of each other. Each lane is equipped with counting means to provide the proper number of goods to be packed in each of Boxes A and B. Although the lanes 14–19 operate independently of each other, means are provided for determining that the predetermined number of goods are in place to fully pack the boxes before the goods are released. In the preferred embodiment, each lane packs one row of five stacks of approximately twenty (20) patties. Each box receives goods from three lanes. Therefore, the goods are packed three across, five deep in columns of approximately twenty (20) patties. It should be understood that any number of lanes may be utilized to pack any number of goods within the broad scope of this invention.

The goods move along lanes 14–19 to sorting or classifying means 28. After the goods are classified, they continue on conveyors to the counting and spacing means 30. A predetermined number of goods 12 are counted and at timed intervals are allowed to travel to the stacking means 32. The stacking means 32 positions the goods for placement in containers. Packing means 34, cooperatively connected to the stacking means 32, positions and packs the goods 12 in the boxes or other containers in an orderly fashion. Control means 36 controls the timing of the apparatus based on the specified count.

Figure 2:
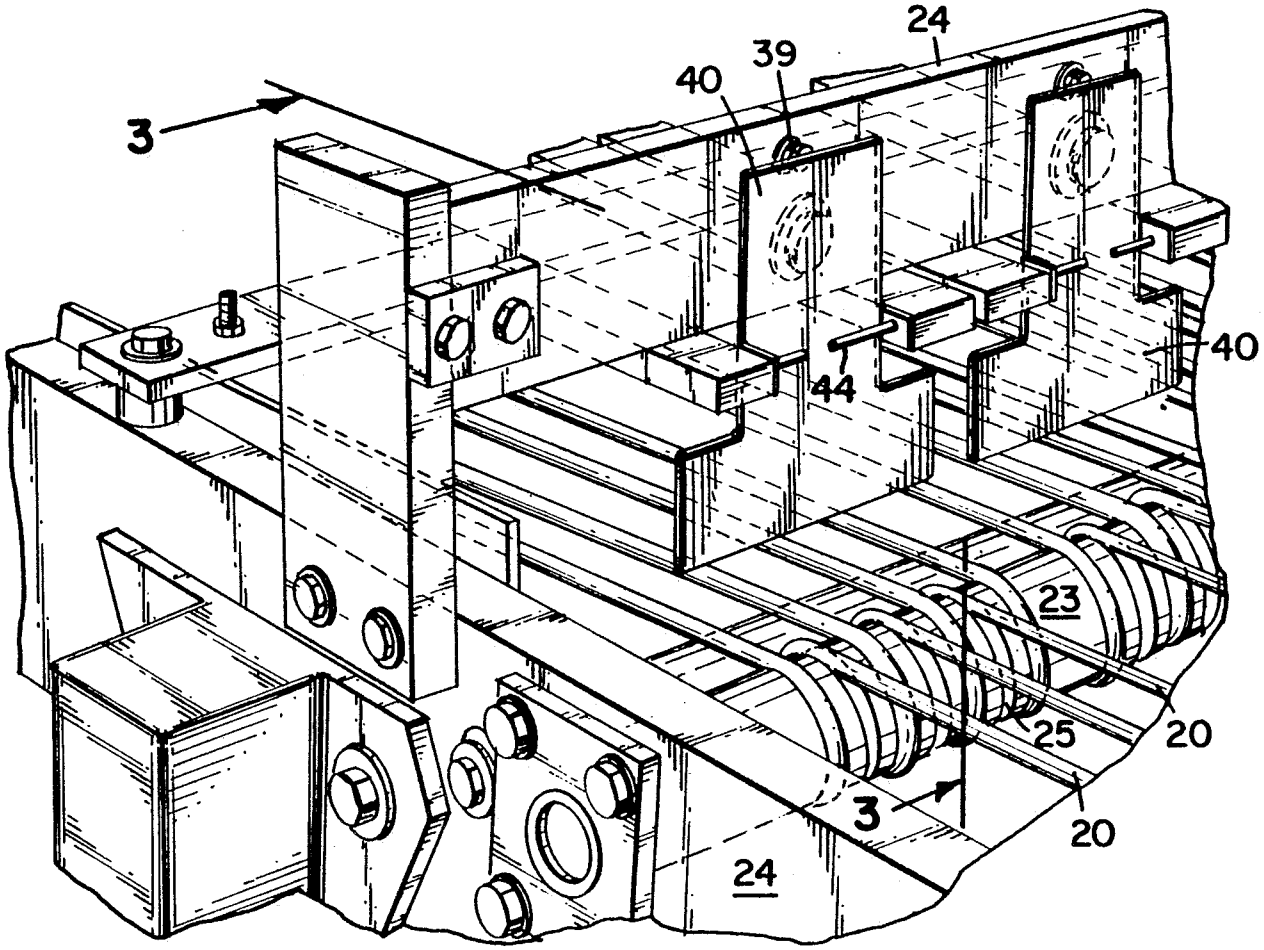
FIG. 2 is a perspective view of the sizing means of the present invention.
Figure 3:
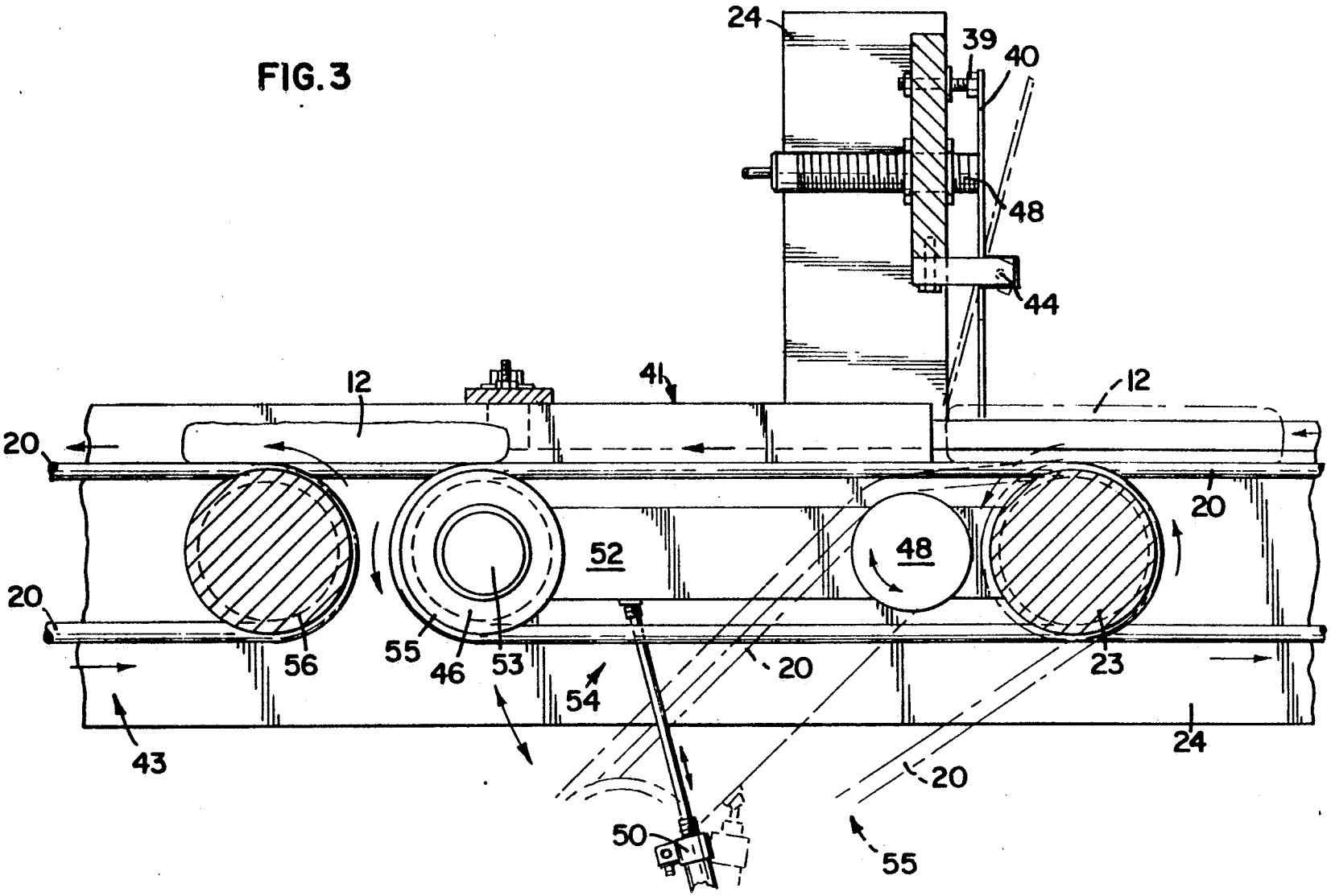
FIG. 3 is a partial cross-sectional view of the sizing means of the present invention taken along the line 3—3 of FIG. 2,.

Referring now to FIGS. 1, 2, and 3, six lanes 14–19 are shown. For purposes of illustration, one lane 14 of the apparatus will be described in detail, although it should be understood that all lanes of the apparatus are generally the same in the preferred embodiment. Lane 14 includes conveyor 21. The conveyor 21 includes bands 20 and rollers or pulleys 22 and 23. The bands 20 are of polyurethane material in the preferred embodiment. However, it should be understood by those skilled in the art that any suitable materials or means for providing conveyance of the goods 12 may be utilized, such as belts or chains. Three bands 20, in the preferred embodiment, are configured to wrap around rollers 22 and 23. The rollers 22 and 23 are cooperatively connected to frame 24 of the apparatus 10. Any suitable means may be utilized to connect the conveyor 21 to the frame. The rollers 22 and 23 include grooves 25 which are sized and configured to receive bands 20. Suitable power means 26 are connected to the roller 58 to be described later. The motor 26 is a ½ horsepower motor of a conventional type in the preferred embodiment. The power means or motor 26 drives roller 58 which in turn drives the bands 20 around roller 56. Roller 56 then drives roller 23 by a connecting band 20' and in turn, roller 22 to move the goods 12. The goods 12 are placed on top of the bands 20.

As illustrated in FIGS. 2 and 3, retainers or gates 40 are connected to the frame 24 of the apparatus 10 and, in the preferred embodiment, are positioned perpendicular to, and aligned with the lane 14. In the preferred embodiment, the gate 40 is generally T-shaped and made of stainless steel, although any other suitable configuration and material may be utilized. Pivot arms 44 connect the gate 40 to the frame 24 and allows the gate 40 to rotate about the axis of the pivot arms 44, as shown in FIG. 3. Gate 40 is positioned a predetermined distance from the lane 14. A stop 39 is connected to the frame 24 and provides a stop for gate 40 to control its position.

The classifying means 28 includes a second conveyor 41 to move the goods 12. Conveyor 41 includes a second set of bands 20 which are connected to roller 23 and engage a third roller 46. The bands 20 are received by grooves (not shown) as described above in regard to conveyor 21. The axis of third roller or pulley 46 is generally parallel to the axis of roller 23 and the bands 20 are driven by roller 58 which is powered by power means 26 as described above. A pivot shaft 48 is located between and parallel to rollers 23 and 46 positioned generally below gate 40. A rod 52 connects roller or pulley 46 and pivot shaft 48. Pulley 46 is constructed in a manner such that rod 52 is connected to an axle 53 which allows a wheel 55 to rotate to allow movement of the goods 12. Pivot shaft 48 pivots about its axis as shown in FIG. 3. An air cylinder 50 is cooperatively connected to rod 52 and operates in two positions 54 and 55, as illustrated in FIG. 3. A source of compressed air (not shown) is connected to the cylinder 50 to power it. In first position 54, the cylinder 50 maintains the second conveyor 41 in a position where roller 46 is in generally the same plane as roller 23. In its second position 55 shown in phantom, the cylinder 50 moves the rod 52 downward and therefore, roller 46 into a different plane than roller 23. In this manner, the bands 20 follow and generally wrap over pivot shaft 48 as shown.

A switch 48 is operatively connected to gate 40 of the present invention. The switch 48 is a conventional proximity switch in the preferred embodiment and is manufactured by Turck. Appropriate ground, bias and connectors are utilized in the present invention. Switch 48 is activated by movement of the gate 40 about pivot arm 44. The gate 40 rotates about arm 44 when contacted by goods 12 which are thicker, have a greater height or carry a deformity such as a nub or knot. Because the goods are of a size different than a predetermined size equal to the distance between gate 40 and conveyor 21 the goods fall below and are not included in the packing. The predetermined distance between the bottom of gate 40 and conveyor 21 is set by the specification of the goods 12. In the preferred embodiment, this distance is approximately ⅜ of an inch. The activation of switch 48 moves cylinder 50 from position one 54 to position two 55 dropping toward the ground. Therefore, the oversized goods 12 follow the bands 20 of conveyor 41 and are removed from the apparatus 10. Subsequently, the cylinder 50 and thus, rod 52, returns to first position 54 and the goods 12 can continue to move along the apparatus 10. Flow control (not shown) is provided in the preferred embodiment. The control is connected to cylinder 50 and allows the cylinder 50 to quickly move from position 54 to position 55 and to move from position 55 to position 54 generally more slowly. This control allows for patties which may have a knot toward the last portion to contact gate 40 to trigger the switch and drop but return the conveyor 41 to move the next pattie.

Figure 7:
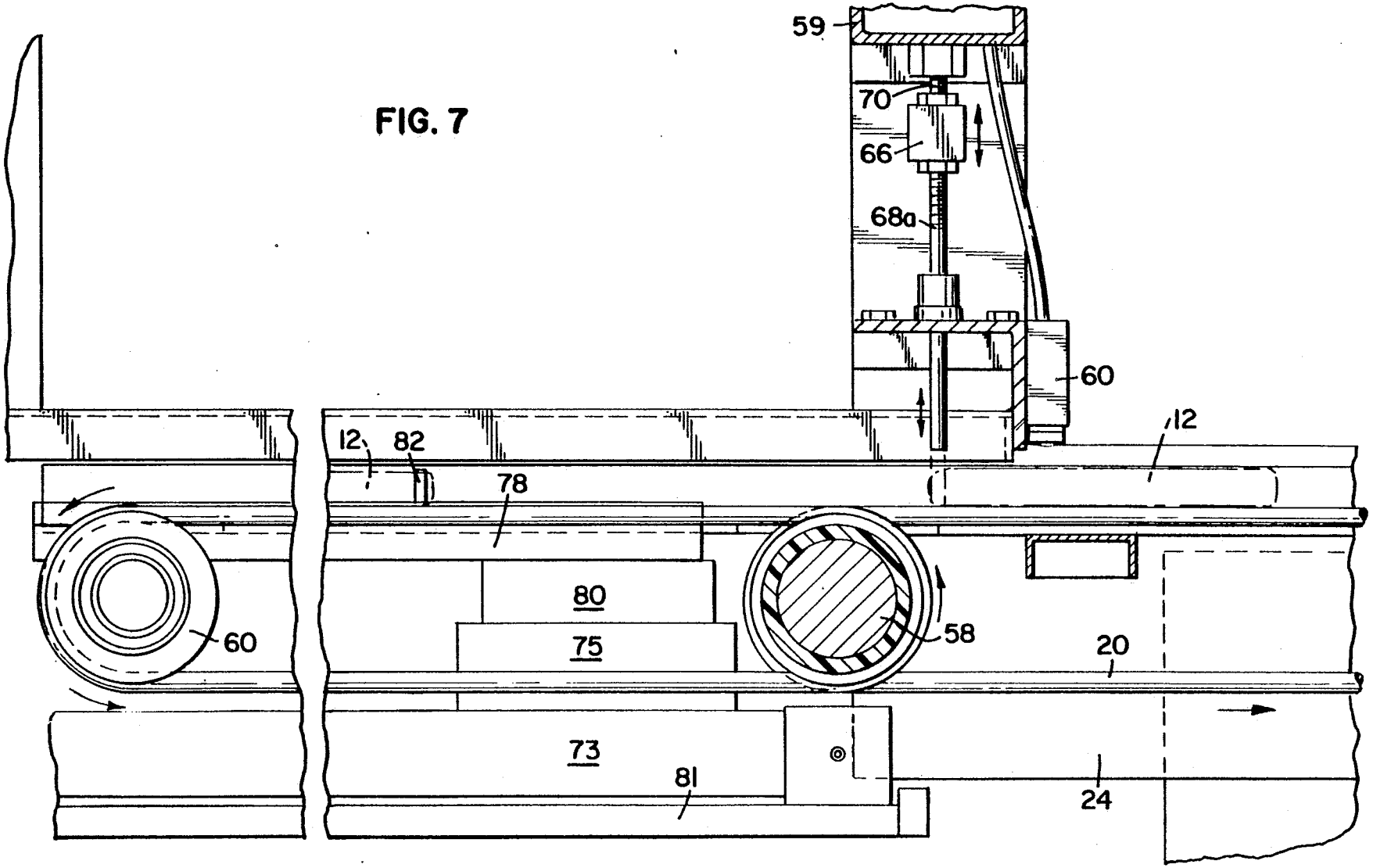
FIG. 7 is a partial cross-sectional view of the stacking and spacing means of the present invention taken generally along the line 6—6 of FIG. 5.

Goods 12 which fit within the predetermined parameters continue to pass along the lane 14 on conveyor 43. The conveyor 43 includes rollers 56, 58 and bands 20. Fourth roller 56 is connected to the frame 24 of the apparatus 10 and is positioned proximate roller 46 as illustrated in FIG. 3. The fourth roller 56 is generally parallel to third roller or pulley 46. The rollers 46 and 56 are arranged such that the gap between them is of such a size that the goods 12 may not fall in between but will continue to move downstream toward the boxes which hold the packed goods. Fifth roller or pulley 58 is connected to frame 24 downstream of fourth roller 56 as shown in FIG. 7. A third set of bands 20 engage the fourth roller 56 and the fifth roller or pulley 58. The roller 58 is powered by power means or motor 26 and therefore drives the bands 20 and roller 56 to move the goods 12. The goods are moved downstream to the counting and retaining means 30. Guides 31 are connected to the frame 24 in the preferred embodiment to help the travel of the patties along the conveyors 21, 41 and 43. The guides 31 are generally L-shaped in cross-section.

Figure 4:
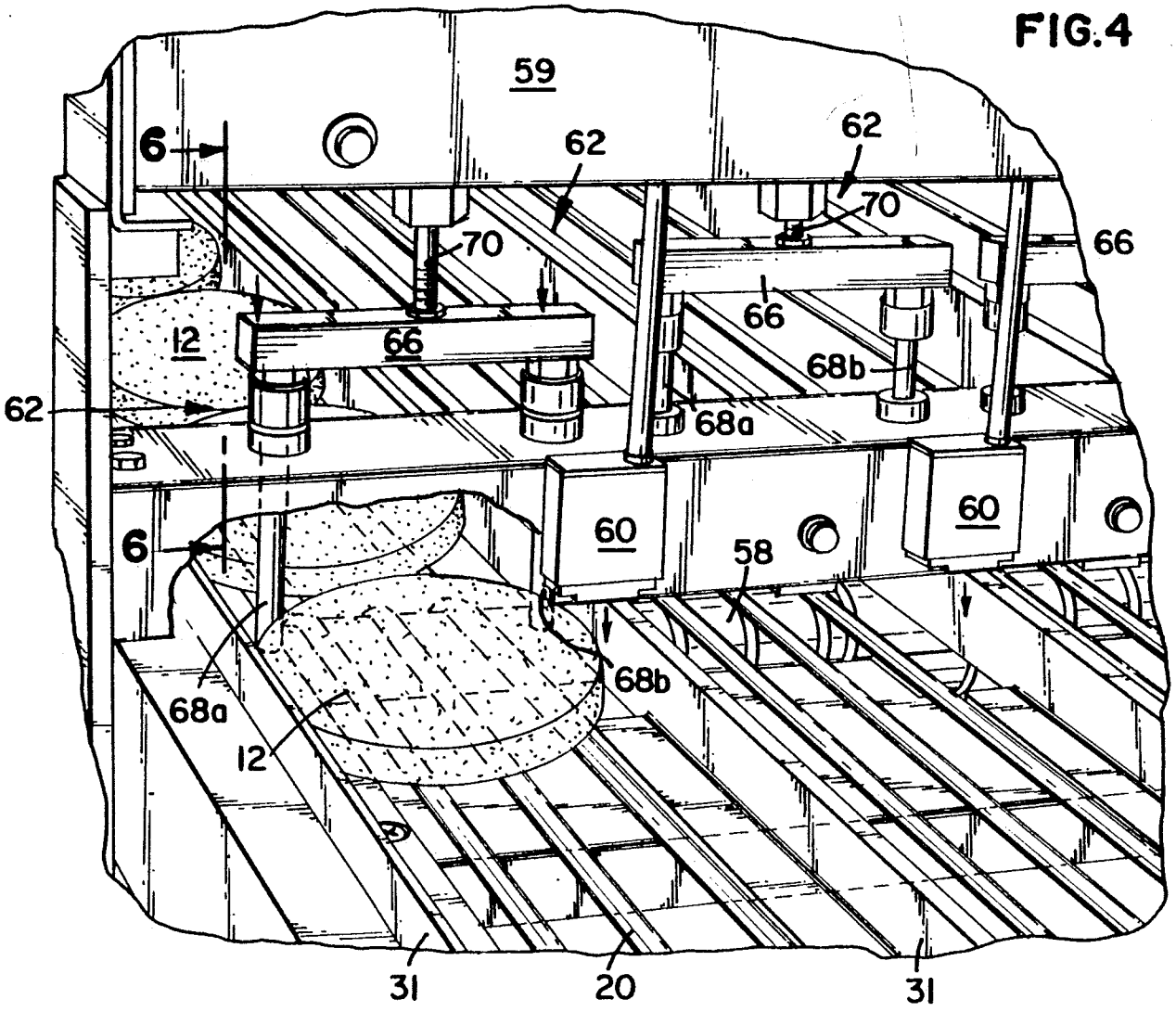
FIG. 4 is a perspective view of the counting and spacing means of the present invention.
Figure 14:
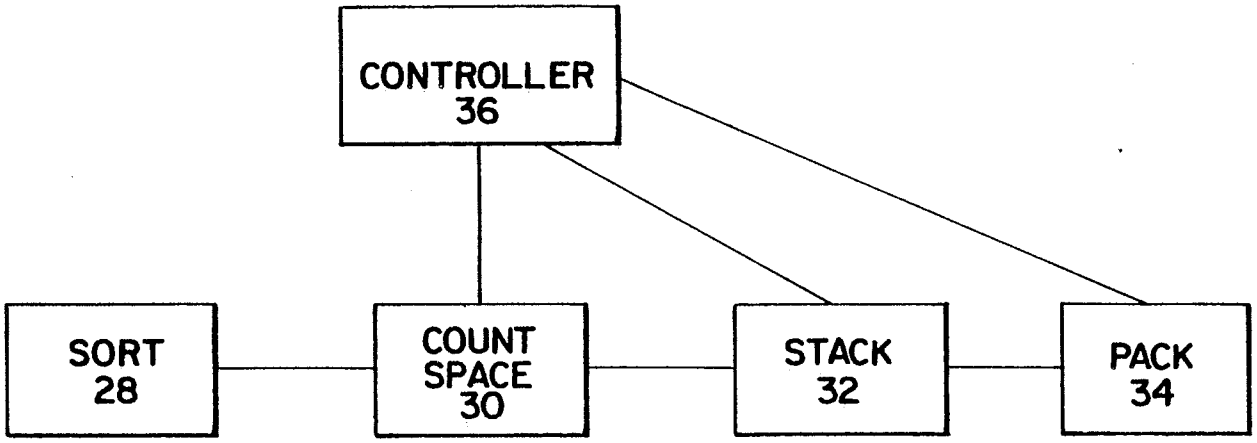
FIG. 14 is a block diagram illustrating the control system of the present invention.

Referring now to FIG. 4, the counting and retaining means 30 is shown. The counting means 30 includes support 59, electric eye 60, retainers 62, and a compressed air source (not shown). The support 59 is connected to frame 24 by conventional means. Retainer 62 includes member 66 having prongs 68 a and b which are positioned perpendicular to and proximate each end of member 66. The member 66 is operatively connected to piston 70. A compressed air source is connected to piston 70 through pneumatic valves shown in box 59 and supply lines 61 to provide upward and downward movement of the retainers 62. The valves 59 are of a conventional type and supply air through lines 61 when activated by the control means to be described later in this description. When the separator 62 is in an upward position, as illustrated in FIG. 7, the goods 12 may pass. When the separator 62 is in a downward position, as illustrated in FIG. 4, the prongs 68 provide a barrier to the passage of the goods 12. The movement of the retainers 62 is controlled by electric eye 60. Electric eye 60 is operatively connected to the retainer 62 by standard means. In the preferred embodiment, the eye 60 counts the passage of the goods 12. After a predetermined number of goods 12 have passed, the eye 60 actuates the air source 64. Piston 70 then moves downward moving the prongs 68 into the line of travel of the goods 12 and the goods 12 are stopped as shown in FIG. 4. The prongs 68 are positioned to move down into the space provided between two disc-shaped articles. In this manner, the goods 12 are retained but are not damaged by the downward motion of the prongs 68. A controller 36, shown in block diagram in FIG. 14, is connected to the separator 62. The controller 36 controls the length of time that the prongs 68 remain in the downward position. In the preferred embodiment, the electric eye 60 counts five patties as they pass under it. After five patties have passed, the prongs 68 are moved into position to stop further passage of goods 12. At the appropriate time, to be described below, the prongs 68 are lifted and five more patties may pass to be stacked and packed.

Referring now to FIG. 5, the cycle of the stacker 32 is diagrammatically shown. The stacker or horizontal delivery means 32 comprises a slide plate device 70 and includes three moving means or cylinders 72, 74, and 76. In the preferred embodiment, the moving means include rodless cylinder 72 and air cylinders 74 and 76. However, it should be understood that any suitable means for proper movement of the device 70 may be utilized. The slide plate device 70 includes plate 78 and member or spacing block 80, made of stainless steel. The plate 78 includes nodules 82. The plate is generally rectangular in shape. The nodules 82 are generally cylindrical in the preferred embodiment and are made of stainless steel. Plate 78 is supported by member 80 on rodless cylinder 72. Rodless cylinder 72 is connected to member 80 and includes carriage 73 and piston mounting block 75. Mounting block 75 is connected to a compressed air source which powers the device 70 such that mounting block 75 slidably engages carriage 73. Therefore, plate 78 is moved in a horizontal plane. The rodless cylinder or moving means 72 engages the member 80 and forces plate 78 along a horizontal plane as shown in FIG. 5.

Air cylinders 74 and 76 are connected to support carriage 73 by mounting plate 81. Any suitable mounting may be utilized within the broad scope of this invention. The cylinders 74 and 76 move the carriage 73 and plate 78 in a vertical plane. Therefore, the plate 78 is moved vertically between two positions and horizontally between two positions as shown in the diagrammatic illustration of FIG. 5. The slide plate device 70 moves in a cycle including four steps.

Figure 5A:
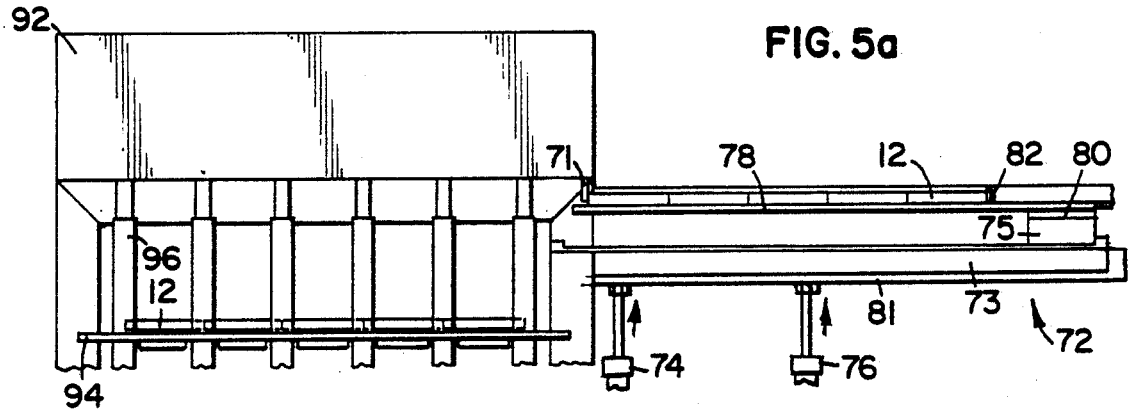
FIGS. 5*a* through 5*d* are side elevational views.
Figure 5B:
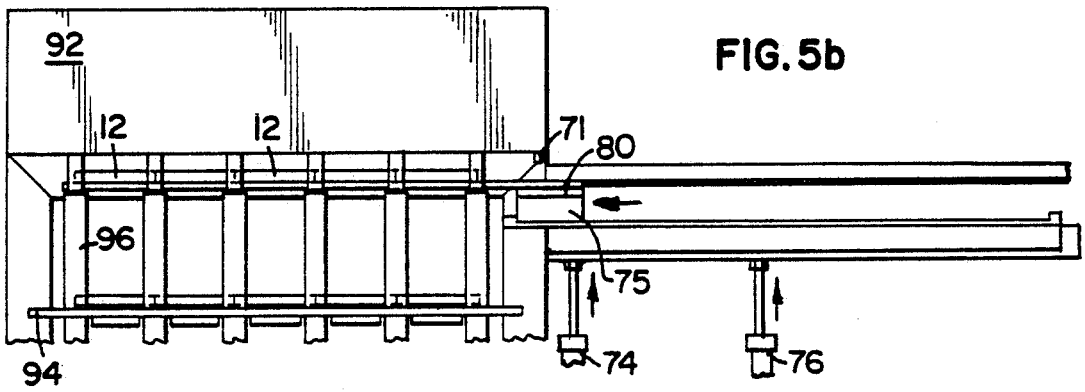

The cycle moves the goods 12 into the packing means 34 to be described in more detail later in this description. As shown in FIGS. 5, 6, and 7 the goods 12 move along a conveyor 53 until they reach stop 71 positioned at the end of conveyor 53. The stop 71 is driven up and down by a pneumatic cylinder (not shown). The controller 36 controls the stop 71. Compressed air is provided to the pneumatic cylinder to move the stop up and down. The controller 36 moves the stop up when the slide plate 78 starts forward in the preferred embodiment. The predetermined number of goods are then contacted by plate 78 in the manner described below. Plate 78 is of a predetermined length. The nodules 82 are positioned to contact the last good or patty to be stacked. Therefore, in the preferred embodiment, the length of the plate 78 from the stop 71 to the nodule 82 is a length generally equal to the length of five patties. When the plate 78 is moved into position to contact the goods 12 the nodules 82 contact the last patty as shown in FIG. 6.

Conveyor 53 includes a fourth set of bands 20, roller 58 and pulleys 60. The conveyor 53 is driven by motor 26 which drives roller 58. The bands 20 of conveyor 53 are positioned proximate the outer edges of the rollers 58 and pulleys 60. The positioning of bands 20 on roller 58 is shown in FIG. 6. Roller 58 includes grooves 61 for the bands 20 to travel in. There are two bands 20 in conveyor 53. The bands 20 each contact a pulley 60, each connected to the frame 24 of the apparatus 10 proximate stop 71. Pulleys 60 are positioned such that slide plate 78 may move in between them. Again, guides 31 are utilized to aid in positioning the goods 12. Bar 57 is also utilized above the goods 12 to keep them from buckling and moving out of position. In this manner, the bands 20 contact the goods at their edges. The positioning of the bands 20 allows for an open area between the bands. The plate 78 may then move upward by means of cylinders 74 and 76 between the bands 20 to contact the goods 12. The plate 78 contacts the goods 12 as described above so that nodules 82 contact the last patty.

Referring to FIG. 5, the four step cycle of the preferred embodiment is shown. In step one of the cycle, as shown in FIG. 5*a*, cylinders 74 and 76 maintain the carriage 73 in its upward position. The nodules 82 contact the goods 12 and lift them off of the conveyor 53. Step two is illustrated in FIG. 5*b*. Stop 71 is retracted and the carriage 73 is maintained in its upward position. The rodless cylinder is engaged and slides along carriage 73. The plate 78 moves into the packing or vertical retaining means 34 carrying the goods 12.

Figure 5C:
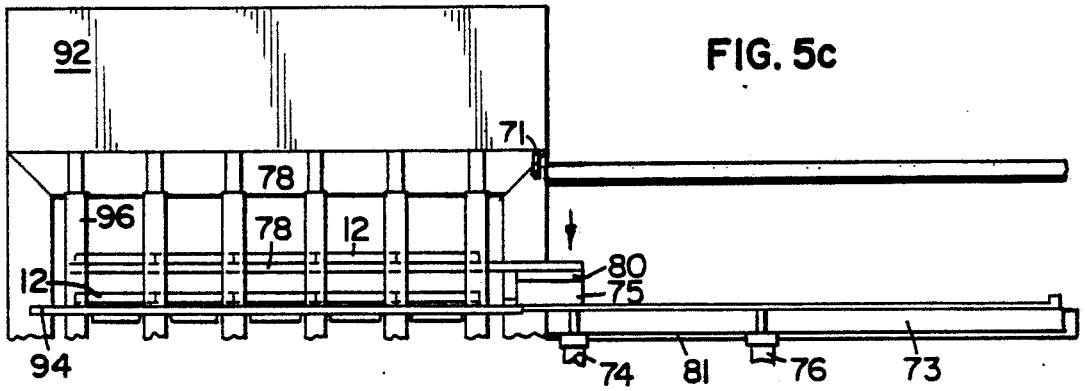
Figure 5D:
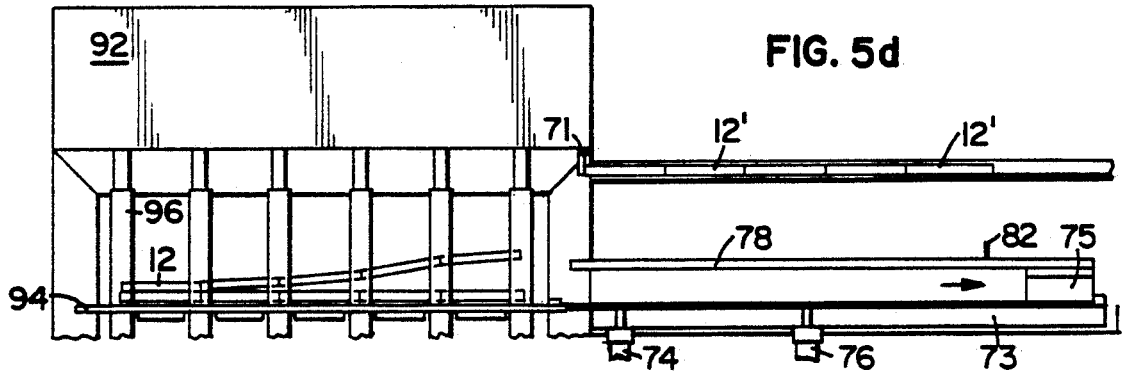
Figure 6:
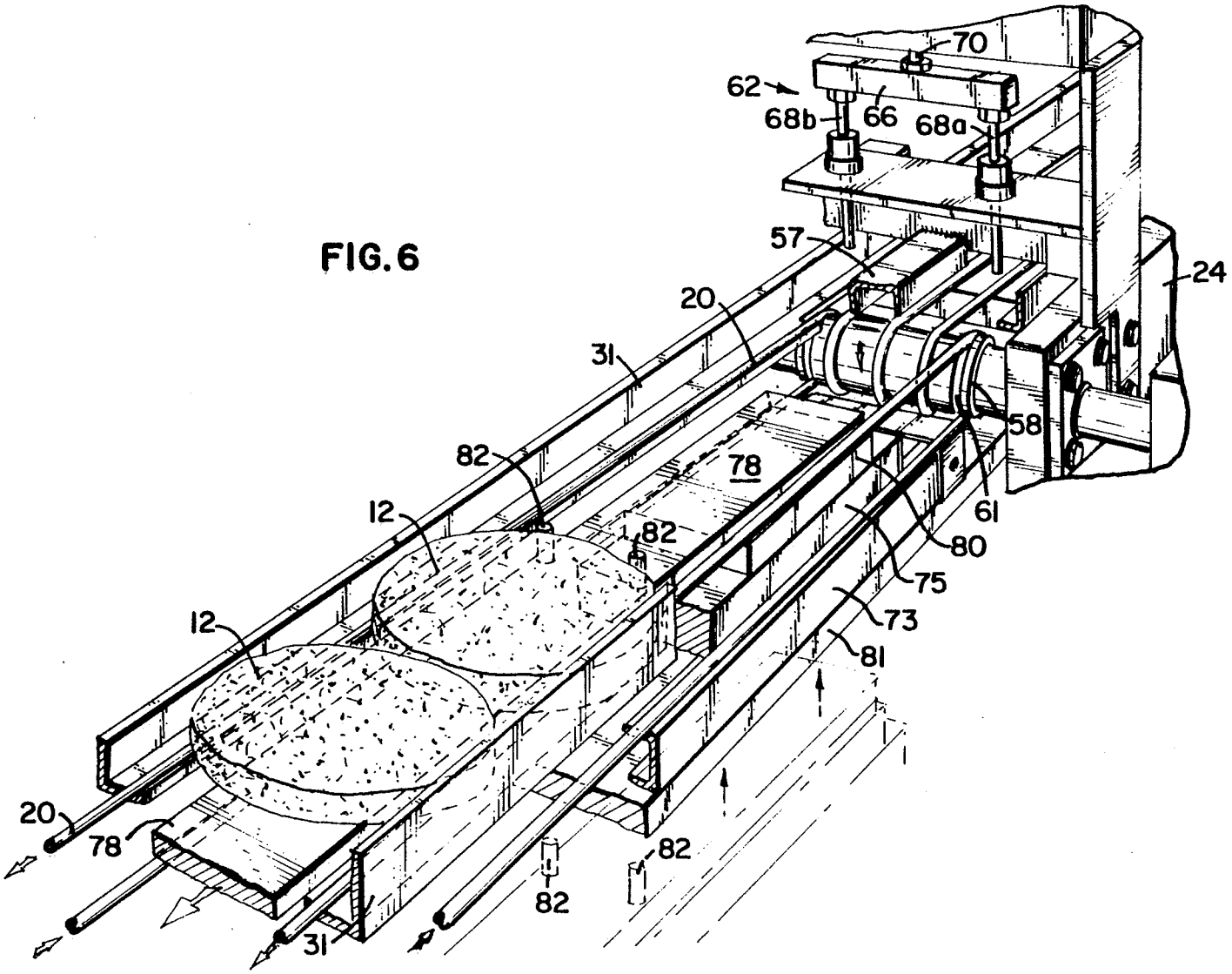
FIG. 6 is a perspective view of the stacking and spacing means of the present invention.

Step three is shown in FIG. 5*c*. The cylinders 74 and 76 move into a downward position thereby lowering the plate 78 and patties 12. Stop 71 is then lowered into a stopping position. The final step is shown in FIG. 5*d*. The rodless cylinder 72 moves out of the packing means 34 and returns to the horizontal position shown in step one. The movement of the plate 78 causes the goods 12 to fall into their proper positions within the packing means 34. The plate 78 may then be moved upward to contact the goods 12 as in step one. In this manner, the cycle continues until a predetermined number of goods 12 are moved into the packing means 34. In the preferred embodiment, and as shown in FIG. 5, goods 12' continue to move on conveyor 53 to stop 71 in a timed manner so that after one completion of the cycle, the next row of goods 12, is picked up. The goods 12 may move retainer 62 on conveyor 53 when the slide plate 78 begins to move out of the packing means 34 as shown in FIG. 5*d*.

Figure 9:
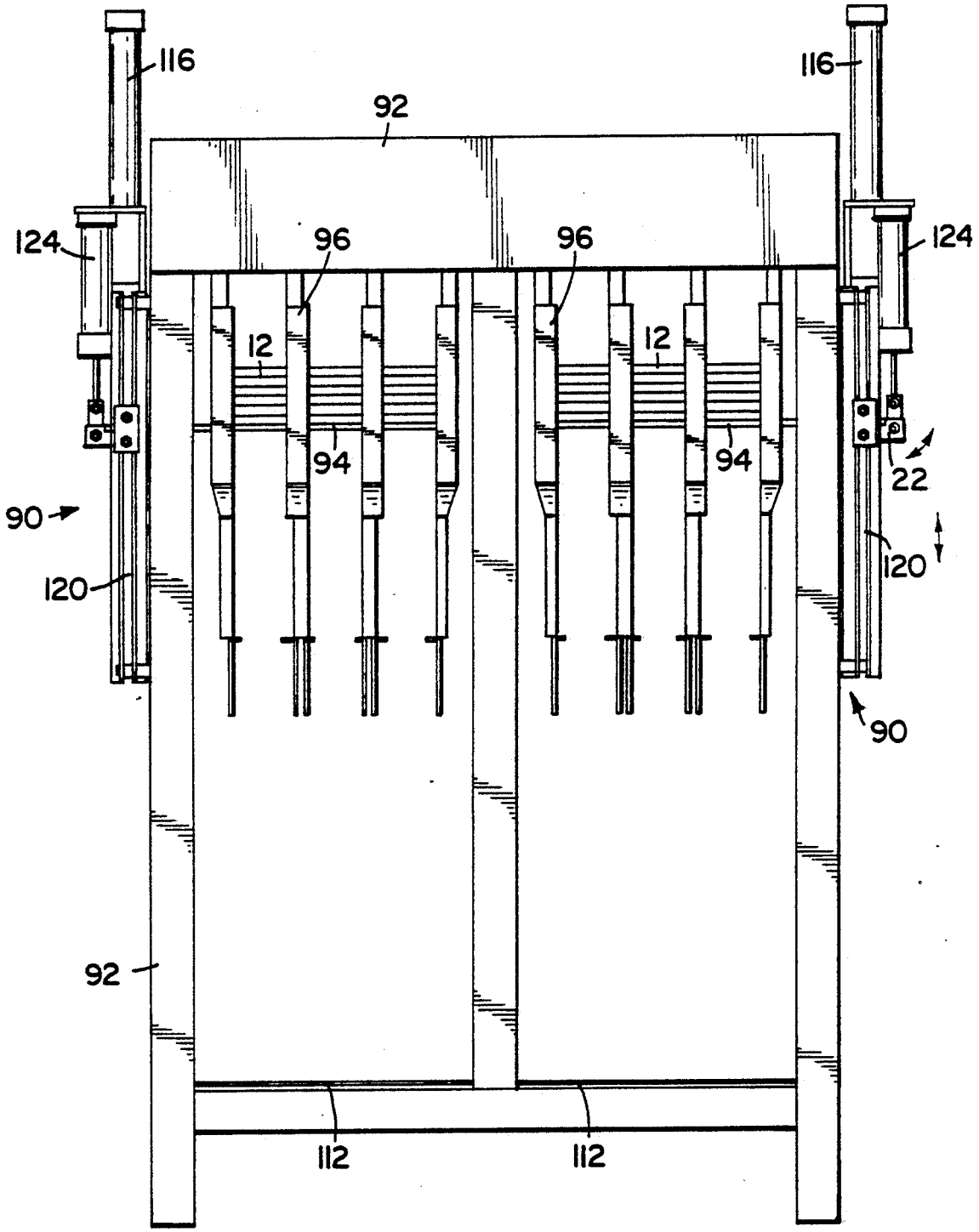
FIG. 9 is an end elevational view of the apparatus of FIG. 1 illustrating the rake of the two lines in an upward position.
Figure 10:
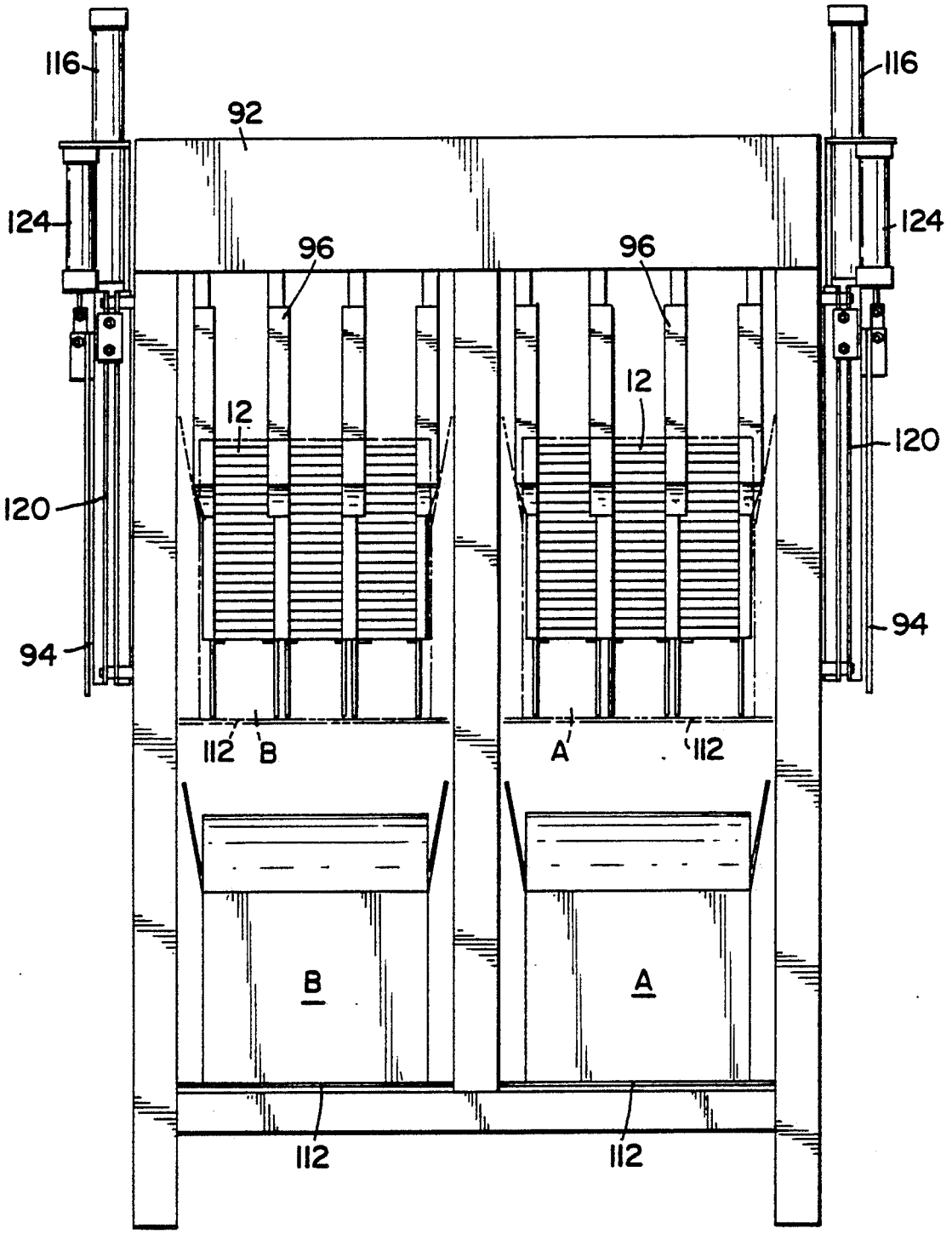
FIG. 10 is an end elevational view of the apparatus of FIG. 1 illustrating the rake in the downward position and the box in a ready position and further, in phantom, illustrating the box in position to receive the goods for each line.
Figure 11:
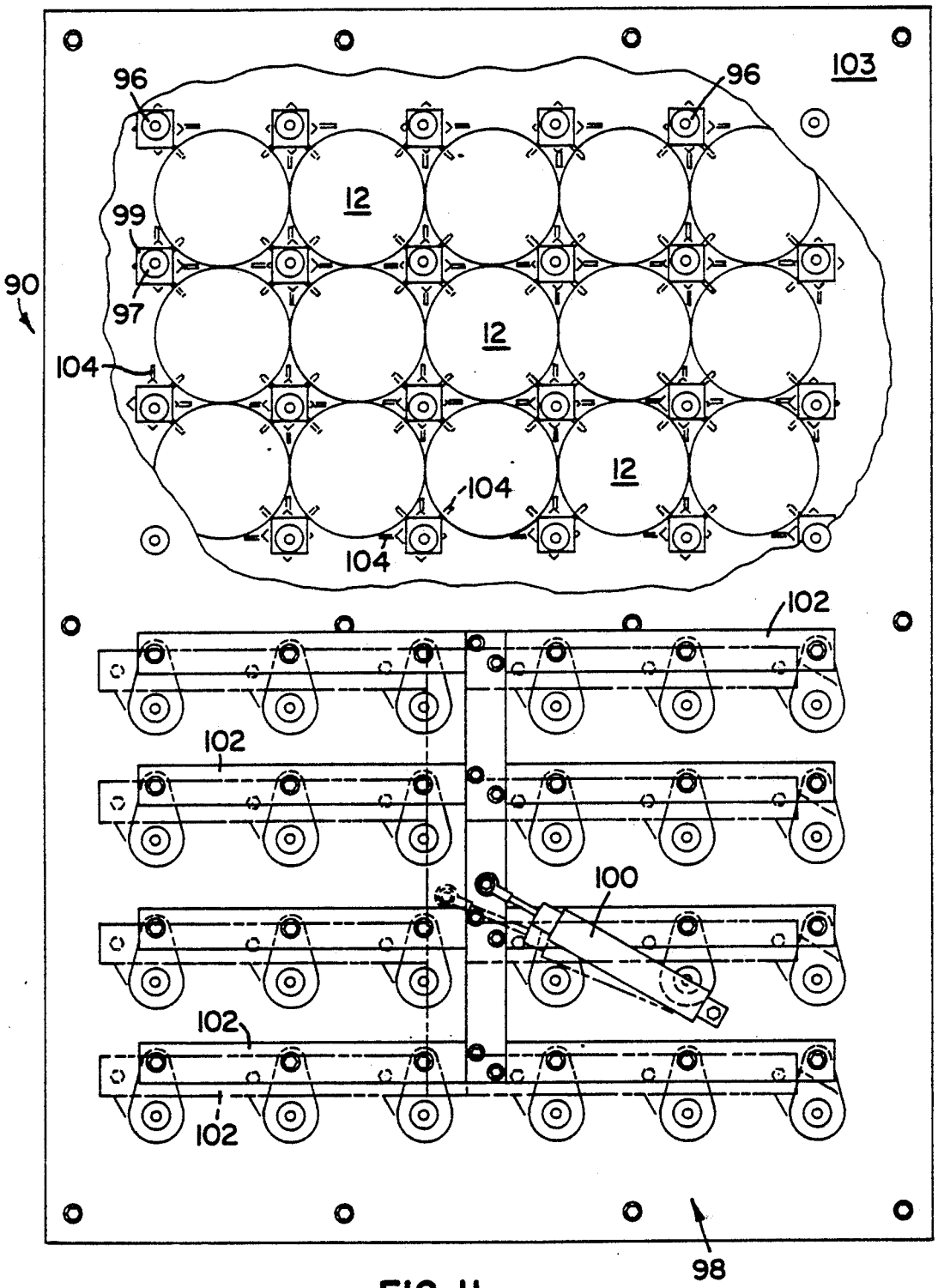
FIG. 11 is a top plan view of the packing means of the present invention.
Figure 12A:
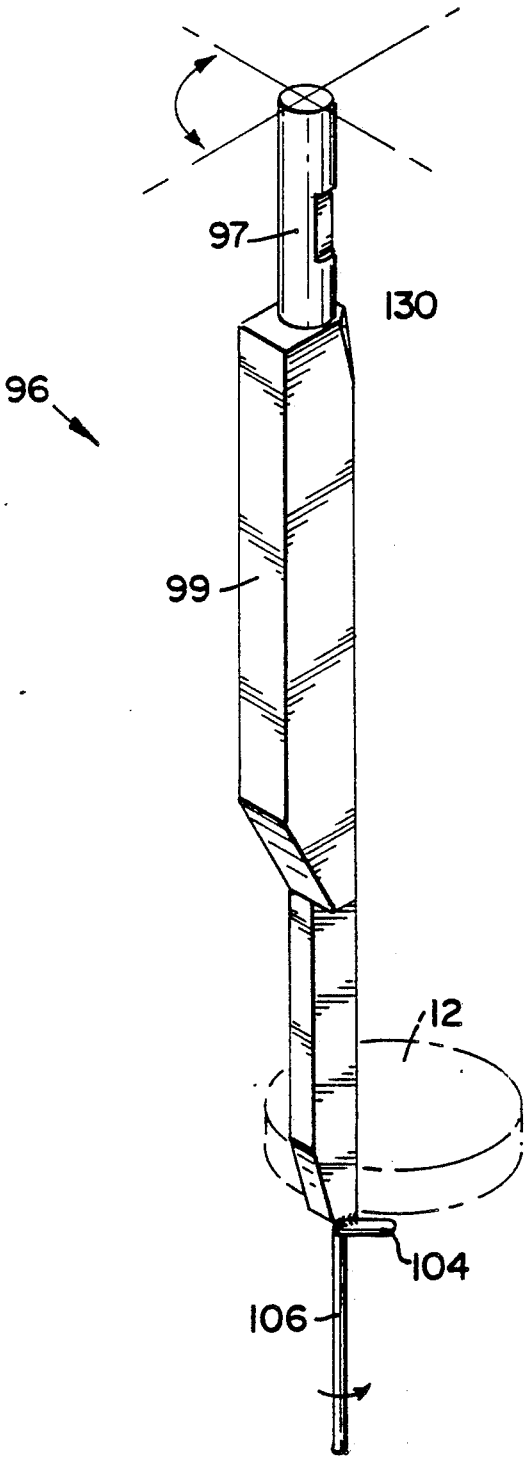
FIGS. 12*a* and 12*b* are perspective views of a spindle of the present invention illustrating the spindle in its two positions.
Figure 12B:
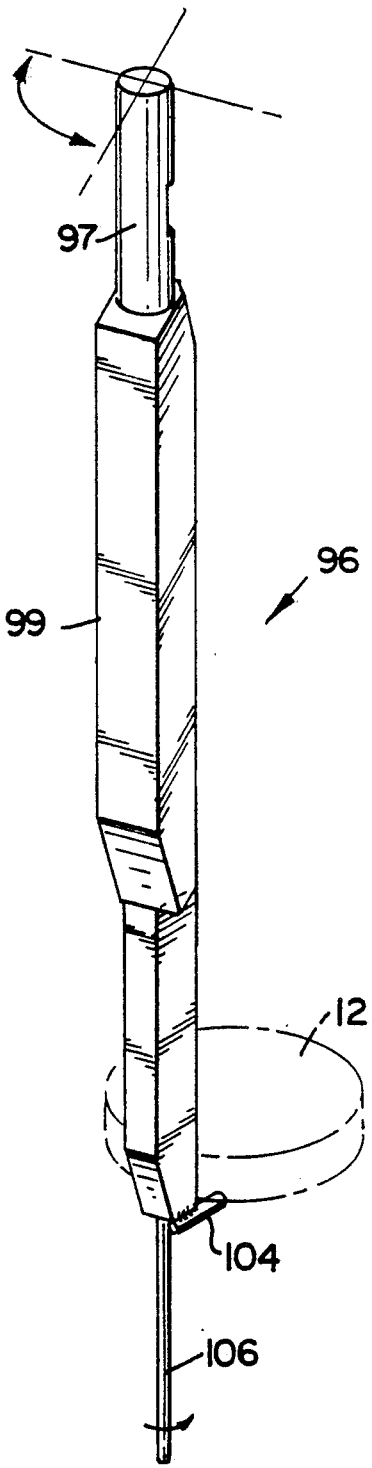
Figure 13:
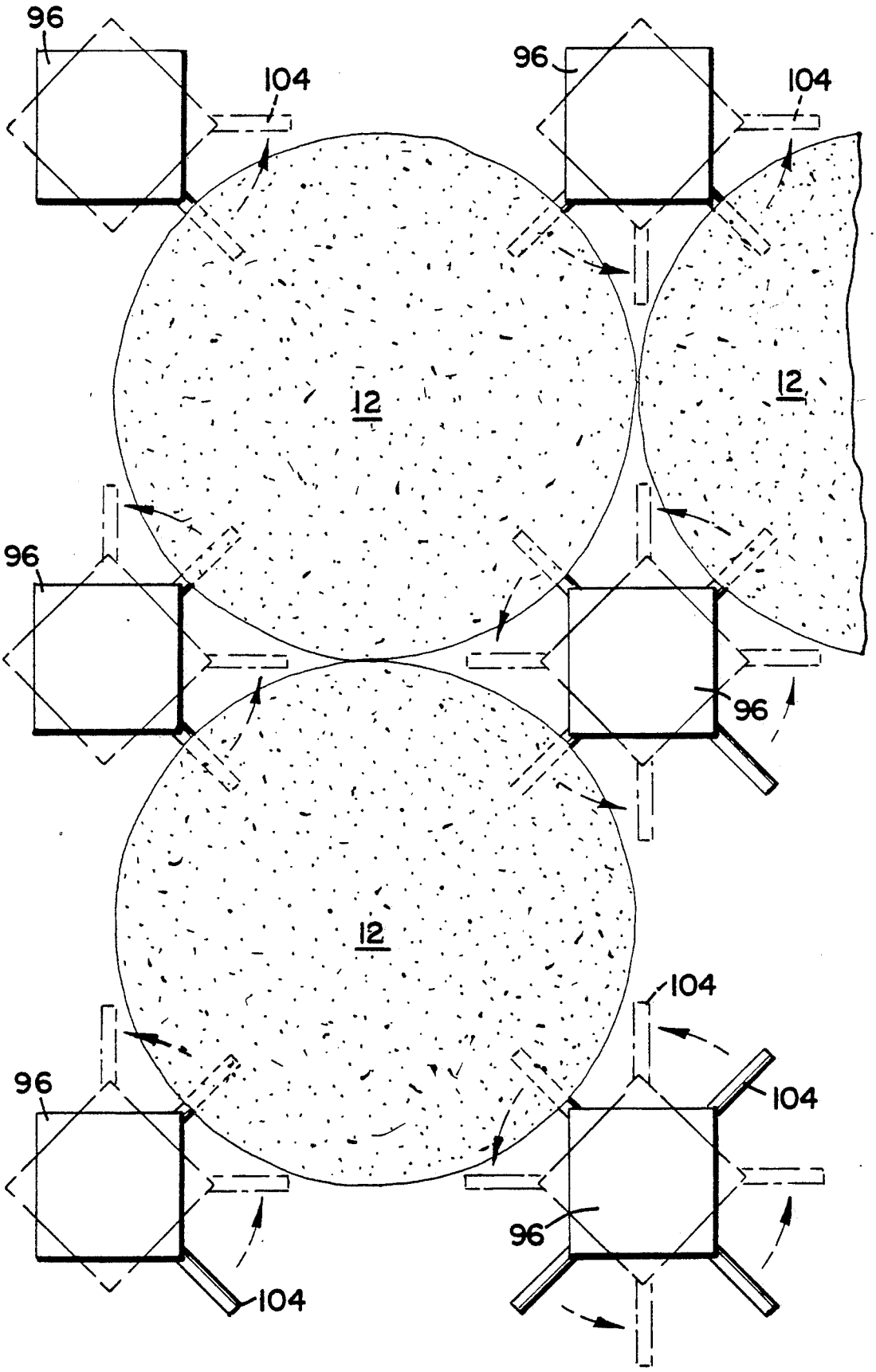
FIG. 13 is a partial top plan view of the spindles of the present invention illustrating the spindles holding the goods and in phantom, the spindles in position for the goods to drop.

Referring now to FIGS. 1, 8–11, the packing or vertical retaining means 34 includes spindle assembly 90, packing frame 92 and rake 94. The spindle assembly 90 comprises a plurality of spindles 96. The spindles 96 are operatively connected to frame 92 by means of rotational device 98. There are forty-eight spindles 96 in the preferred embodiment as shown in FIG. 11. The spindles are comprised of two sets of twenty-four each. Each set corresponds to box A or B. The spindles 96 are spaced to accommodate the shape of the articles or goods to be packed. The spindles are configured to most appropriately guide the patties into the box. As shown in FIG. 12, the spindles 96 are individually positioned. Note that the spindles are generally off center to provide the best results. As shown in FIG. 12, the spindles 96 include a top portion 97 connected to a body 99. Further, spokes 104 are attached to the body 99 proximate the bottom. Guides 106 are connected to the body 99 to guide the placement of patties in the containers. The top portion 97 is generally circular in cross-section while the body 99 is generally square in cross-section. The bodies 99 are generally square in cross-section to gain clearance when they are rotated. The top portion 97 is notched in the preferred embodiment to allow the goods 12 to pass to the proper position in a more smooth manner. The spindles 96 are constructed so that the top portion 97 is of a smaller diameter than the body 99. The goods 12 are moved into the spindle area as described above. In order to move the goods 12 into the properly spaced area they are moved in at the top portion 97 to clear the bodies 99. Once the goods 12 enter the proper spaces they may be lowered to rest in stacks amid the spaces between the spindle bodies 99 and may rest on the spokes 106 or rake 94 to be described later. The rotational device 98 includes an air cylinder 100 connected to members 102. There are two rotational devices in the preferred embodiment corresponding to each set of spindles. The spindles 96 are connected to members 102 by means of crank arms 104 and conventional bearings and set screws (not shown). Plate support 103 is connected by conventional means to frame 92 and is shown in FIG. 11. When the proper number of patties are ready to be placed in a container, cylinder 100 is activated by a compressed air source. Crank arms 104 are engaged and each spindle 96 is rotated approximately 45 degrees so that the spokes 106 are rotated into the dead space between the patties as shown in the cut-away of FIGS. 11, 12 and 13. The spindles 96 are rotated simultaneously by the rotational device 98. In this manner, one box is filled. The boxes A and B need not be filled at the same time. Each spindle set and rotational device operates independently.

Figure 8:
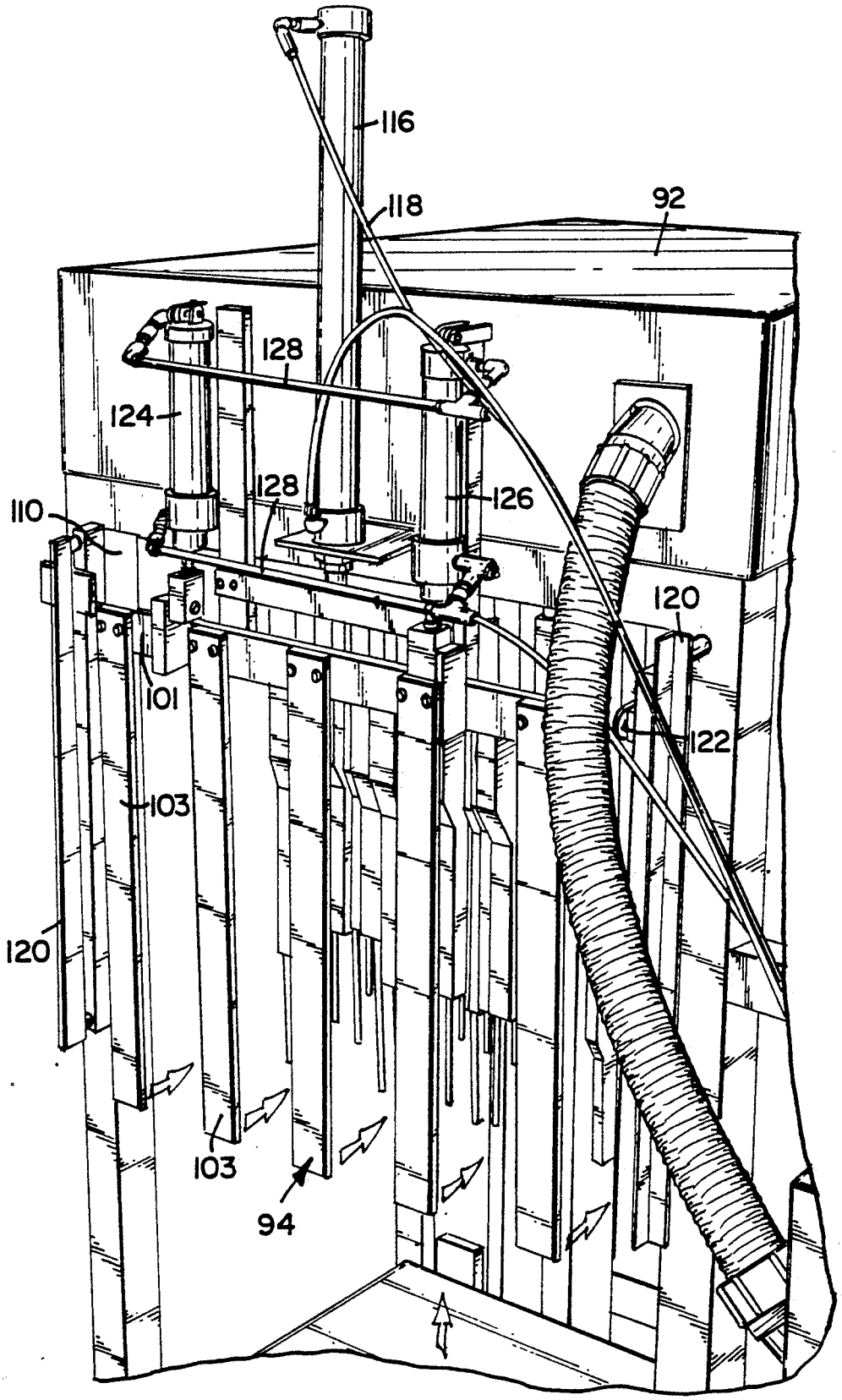
FIG. 8 is a perspective view of the packing means of the present invention illustrating the rake in a downward position.

Referring again to FIG. 8, rake 94 comprises a bar 101 having fingers 103 connected thereto, positioned generally perpendicular to the bar 101. The rake 94 is connected to frame 92 by means of rake support 110. The rake support 110 includes conventional means for allowing the rake 94 to move along frame 92 in the vertical direction. Air cylinder 116 is connected to frame 92 and operatively connected to rake 94 by air lines 118. Rake guides 120 are provided in the preferred embodiment. The rake guides 120 are connected to frame 92 as shown in FIG. 8. Rake guide followers 122 move within guides 120 driven by cylinder 116 to move the rake 94 up and down. The support 110 also includes a shaft 108. The shaft 108 allows the rake 94 to pivot about the shaft axis and move into the spindle assembly. The fingers 103 are configured to move in between spindles 96 as shown by the arrows in FIG. 8 and the end view of FIG. 9. The rake 94 moves in and out of the spindles 96 by means of air cylinders 124 and 126. Compressed air is provided through lines 128 to pivot the rake 94 about arm 108. The rake 94 is moved into the spindle assembly at step one of the stacking cycle as shown in FIG. 5*a*. The rake 94 serves as a support for the patties as they are received in the spindle assembly and remains as a support in the preferred embodiment until the patties are stacked fourteen high. In order to accommodate the increasing number of patties, the rake 94 is moved downward or retracted automatically by the rake support 110 and cylinder 116 described above. At the time when the count of patties reaches fourteen the patties are able to rest on the spokes of the spindles 96. The rake 94 is returned to its retracted position and moved vertically upward to a position for preparation for the beginning of the next cycle.

Platform 112 is connected to frame 92 and is configured to receive a container or box A or B. After the rake 94 is moved out of the spindles 96 and when the count stack is at eighteen, the box A or B is raised to the spindle assembly as shown in phantom in FIG. 10. An air cylinder (not shown) moves the platform up and down to meet the guides and spindles. The spindles are configured to easily fit within the box A or B. The spindles are tapered as shown in FIG. 12 and 9 to allow the box to move over them without catching or moving. The spindles are also tapered generally at point 130 to further guide the patties into the box. The tapers are positioned on the spindles where the patties may contact them. The box is moved upward until the bottom of the box comes into contact with the ends of guides 106. When the full count of forward movements of the slide plate, sixty in the preferred embodiment, is reached, the spindles 96 are rotated as described above to allow the patties 12 to drop in the respective box. The box is then lowered by means of movement of platform 112. An empty box is then placed on the platform 112 to receive the patties from the next complete count. A rodless cylinder (not shown) may be utilized to position the box on the platform 112. The boxes may also be positioned by hand. At this time, the counter for the box filled is set to zero automatically so the next sequence may be started.

In operation, the patties 12 are moved onto each lane 14–19 one at a time. The patties move on conveyor 21 to gate 40. If the pattie is uniform in size and meets the desired specifications, the pattie moves over conveyor 41 to conveyor 43. If the pattie does not meet the predetermined specifications, it is rejected by the classifier 28 as described earlier.

The patties 12 move on conveyor 43 and are connected by electric eyes 60. Each eye 60 counts five patties. This information is relayed to controller 36 and when five patties have passed retainers 62, the prongs 68 are moved into position to stop movement of more patties to the stacking means 32. The slide plate 78 is then moved into position as in FIG. 5*a*. When the slide plate is sent forward by controller 36, the stop 71 is moved so that the plate 78 may move into the spindles 96. Rake 94 is also moved into position when the count is zero in a box cycle. The controller 36 counts every time the slide plate of lanes 14, 15 and 16 moves forward to deposit five patties. The count continues until sixty is reached. By this manner, each lane 14, 15, 16 deposits about 5 rows of 20 patties high or a total of about 300 patties per box.

The slide plate 78 moves forward and then down as in FIGS. 5*b* and 5*c*. When the slide plate begins to move out of the spindle area, the controller 36 allows the prongs 68 to be raised so that five more patties are moved in to the stacking means 32 as shown in FIG. 5*d*. Goods 12' have moved into position while goods 12 are being deposited to rest on the rake 94. The count continues and goods 12 are deposited in the manner described above. The rake 94 is moved downward in the vertical direction as shown in FIG. 9 to make room for the increasing number of patties. When the count in each column is about 14, the rake 94 retracts or moves out of the spindle area as shown in FIG. 10. The goods 12 now rest on spokes 106. The goods 12 continue to be stacked in the spindles 96 until the total count for three lanes reaches sixty.

The box A is signalled by controller 36 to move into position, as shown in phantom in FIG. 10, when the count in each lane is approximately eighteen. When the full count of sixty is reached the controller 36 actuates the rotational device 98 and the spindles 96 rotate approximately 45°, thereby depositing the patties in the box in an orderly fashion. The counts are set to zero and the boxing cycle begins again. The boxes are removed by automatic or manual means and an empty box is moved into position. Air cylinders may be utilized to remove the box from platform 112.

The boxes A and B are filled independently. This independence allows for more accurate counting and packing due to time and counting variations. The controller 36 is programmed so that proper delays and counting are provided. The controller 36 controls the cycle and its various devices. The controller 36 is a programmed apparatus such as a personal computer and may be monitored by the user.

Other modifications of the invention will be apparent to those skilled in the art in light of the foregoing description. This description is intended to provide specific examples of individual embodiments which clearly disclose the invention. Accordingly, the invention is not limited to these embodiments or the use of elements having specific configurations and shapes as presented herein. All alternative modifications and variations of the present invention which follow in the spirit and broad scope of the appended claims are included.

What is claimed is:

1. An apparatus for arranging disc-shaped articles, comprising:

(a) at least one platform member having a width less than the diameter of the disc-shaped articles, wherein said at least one platform member is moveable between a first elevation and a second elevation and between an extended position and a retracted position; and (b) a plurality of spindles, operatively positioned relative to said at least one platform member such that when said at least one platform member is in said extended position, said at least one platform member is positioned between said spindles, and in said retracted position, said at least one platform member is free of said spindles, and said spindles are configured such that a disc-shaped article on said at least one platform member may pass between said spindles when said at least one platform member is at said first elevation, and a disc-shaped article on said at least one platform member is trapped between said spindles when said at least one platform member is at said second elevation.

2. An apparatus according to claim 1, wherein said spindles have prongs extending outwardly from said spindles at a third elevation to releasably retain the articles at said third elevation.

3. An apparatus according to claim 2, wherein said spindles are rotatable between a first orientation and a second orientation, and said prongs are configured to lie below the planform of the articles and thereby retain the articles in said first orientation, and to be free of the planform of the articles and thereby release the articles in said second orientation.

4. An apparatus according to claim 2, wherein spindles on the perimeter of said plurality of spindles are bevelled proximate said third elevation to align a container relative to said spindles.

5. An apparatus according to claim 2, wherein said spindles have spokes extending below said third elevation to guide the articles down into a container.

6. An apparatus according to claim 1, wherein said spindles are bevelled between said first elevation and said second elevation to guide the articles from said first elevation to said second elevation.

7. An apparatus according to claim 1, further comprising at least one plate support having a width less than the diameter of the articles, wherein said at least one plate support is insertable between said spindles to releasably retain and lower the articles some distance between said second elevation and a third elevation.

8. An apparatus according to claim 1, further comprising positioning means for positioning the articles on said at least one platform member further.

9. An apparatus according to claim 8, wherein said platform carriage may be raised or lowered in a generally vertical plane further comprising conveying means for conveying the articles from a source location to said positioning means.

10. An apparatus according to claim 9, further comprising guiding means for guiding the articles being conveyed to said positioning means.

11. An apparatus according to claim 10, further comprising sorting means for removing any excessively thick articles being conveyed to said positioning means.

12. An apparatus designed to package disc-shaped articles of a predetermined thickness and a predetermined diameter, comprising:

(a) a frame;

(b) conveying means for conveying the articles relative to said frame from a source location to a packaging location;

(c) guiding means for guiding the articles being conveyed relative to said frame;

(d) sorting means for removing any articles having a thickness greater than the predetermined thickness;

(e) a platform assembly, operatively connected to said frame, wherein said platform assembly is moveable between a raised position and a lowered position;

(f) a platform member, operatively connected to said platform assembly, wherein said platform member is moveable between an extended position and a retracted position, and said platform member has a width less than the predetermined diameter of the disc-shaped articles; and (g) a plurality of spindles, operatively connected to said frame, wherein said spindles are positioned such that when said platform member is in said extended position, said platform member is positioned between said spindles, and in said retracted position, said platform member is free of said spindles, and said spindles are configured such that a disc-shaped article on said platform member may pass between said spindles when said platform assembly is in said raised position, and a disc-shaped article on said platform member is trapped between said spindles when said platform assembly is in said lowered position, whereby the articles are held between said spindles.

13. A method for arranging disc-shaped articles, comprising the steps of:

(a) collecting the articles in a row on a platform having a width less than the diameter of the articles:

(b) inserting the row of articles on the platform between opposing rows of spindle members at a first elevation where the spindle members define an opening therebetween greater than the profile of the articles;

(c) lowering the row of articles on the platform between the opposing rows of spindle members to a second elevation where the spindle members define an opening therebetween less than the profile of the articles but greater than the profile of the platform;

(d) removing the platform from between the opposing rows of spindle members at the second elevation, whereby the row of articles is captured by the opposing rows of spindle members.

14. A method according to claim 13, further comprising the step of lowering the captured row of articles to a third elevation where the articles are releasably retained by prongs extending from the spindle members beneath the planforms of the articles.

15. A method according to claim 14, further comprising the step of capturing additional rows of articles to obtain a stack of rows of articles releasably retained by the prongs.

16. A method according to claim 15, further comprising the steps of positioning a suitable container beneath the captured rows of articles, and rotating the spindle members to an orientation where the prongs are clear of the planforms of the articles, whereby the rows of articles are released into the suitable container.

* * * * *

UNITED STATES PATENT AND TRADEMARK OFFICE

CERTIFICATE OF CORRECTION

PATENT NO. : 5,069,019

DATED : December 3, 1991

INVENTOR(S) : Lodewegen

It is certified that error appears in the above-identified patent and that said Letters Patent is hereby corrected as shown below:

In Column 2, Line 41, delete ".", after the word "views".
In Column 2, Line 41, after the word "views", insert --of the stacking and packing means illustrating the four step cycle utilized with the present invention.--
In Column 6, Line 44, "nodule" should read --nodules--.
In Column 7, Line 26, "12," should read --12'--.

In Column 3, Line 11, "box" should read --Box--.
In Column 3, Line 13, "box" should read --Box--.
In Column 7, Line 38, "box" should read --Box--.
In Column 8, Line 11, "boxes" should read --Boxes--.
In Column 8, Line 49, "box" should read --Box--.
In Column 8, Line 51, "box" should read --Box--.
In Column 8, Line 55, "box" should read --Box--.
In Column 9, Line 46, "box" should read --Box--.
In Column 9, Line 57, "boxes" should read --Boxes--.
In Column 10, Line 61 (claim 9), please delete the words "wherein said platform carriage may be raised or lowered in a generally vertical plane"

Signed and Sealed this

Twenty-seventh Day of April, 1993

*Attest:*

MICHAEL K. KIRK

*Attesting Officer*

*Acting Commissioner of Patents and Trademarks*